United States Patent [19]

Dunphy et al.

[11] Patent Number: 4,483,162

[45] Date of Patent: Nov. 20, 1984

[54] LOCKING MECHANISM

[75] Inventors: Gerald F. Dunphy, Glen Waverley; Hans J. Esser, Keysborough, both of Australia

[73] Assignee: Ogden Industries Pty. Ltd., Huntingdale, Australia

[21] Appl. No.: 376,258

[22] Filed: May 7, 1982

[30] Foreign Application Priority Data

May 12, 1981 [AU] Australia ..... PE8815

[51] Int. Cl.[3] ..... E05B 65/06; E05B 17/04; E05C 1/06

[52] U.S. Cl. ..... 70/134; 70/380; 292/142; 292/143

[58] Field of Search ..... 70/129, 134, 379 R, 70/380, 472; 292/142, 143, 140, 172, 169.15, 173

[56] References Cited

U.S. PATENT DOCUMENTS

| | | | |
|---|---|---|---|
| 3,167,943 | 2/1965 | Schreiber | 70/379 R |
| 4,248,068 | 2/1981 | Esser | 70/134 |
| 4,301,667 | 11/1981 | Best | 70/380 |

*Primary Examiner*—Robert L. Wolfe
*Attorney, Agent, or Firm*—Berman, Aisenberg & Platt

[57] ABSTRACT

An actuator assembly in which the actuator is usually the rotatable barrel of a key operated tumbler lock. The actuator assembly is connectable through a non-circular drive spindle to any conventional deadbolt assembly of the kind having a tubular housing securable to support, a lever rotatably mounted on the housing and a deadbolt slidably mounted within the housing and responsive to rotation of the lever. A body member of the actuator assembly is securable to the support separate from the deadbolt housing and the lock barrel is rotatable relative to that body member. A gear segment secured to the barrel for rotation therewith is engageable with another gear segment rotatably carried on the body member, but only during part of its possible 360° movement from the rest or locked position of the barrel. The other or driven gear segment has a drive spindle secured to it and that spindle engages within a bore of the bolt assembly lever to transmit rotation of the driven gear segment of the lever.

5 Claims, 14 Drawing Figures

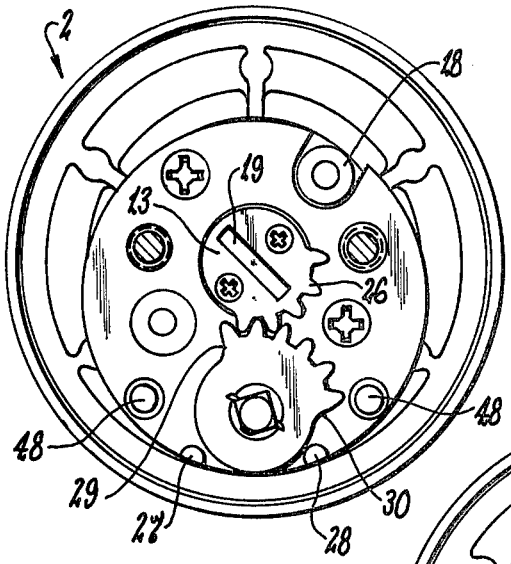
Fig 5
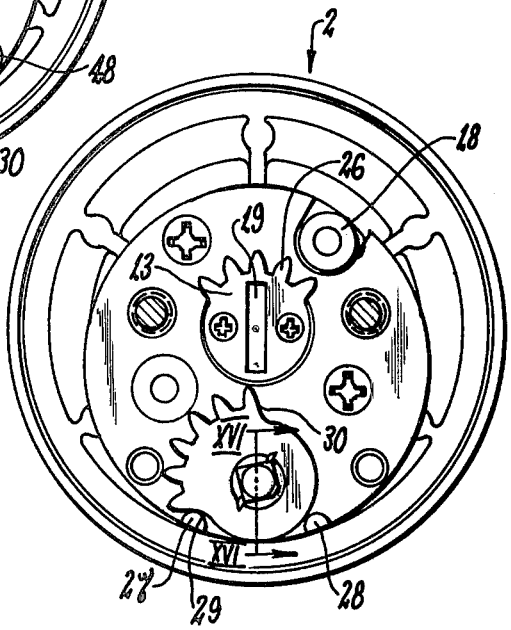
Fig 6
Fig 12
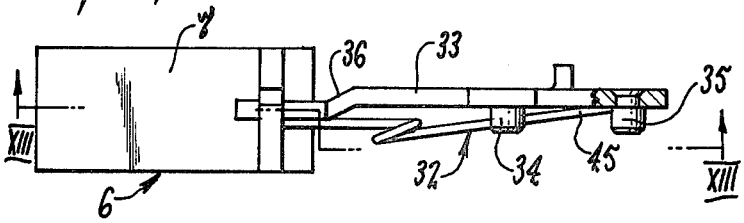
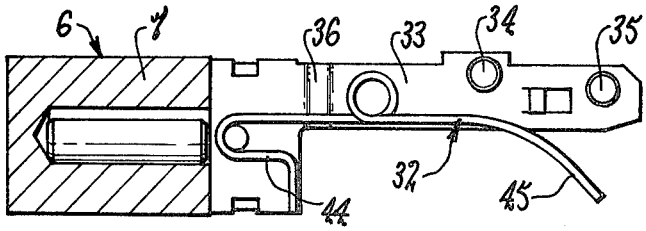
Fig 13

LOCKING MECHANISM

This invention relates to locking mechanisms and is particularly although not exclusively concerned with deadlocking mechansims. It will be convenient to hereinafter describe the invention with particular reference to tubular deadlock mechanisms as an example application of the invention.

Tubular deadlocks have some advantages including convenient installation but generally suffer a serious security problem. Such deadlocks are usually capable of independent operation from inside and outside the associated door by means of a knob or handle and a key operated tumbler lock respectively, although key operation for both sides is sometimes provided. Because of such two sided operation it is normal to provide lost motion in the connection between the actuator (e.g., knob or handle) and the tumbler lock barrel. It is also normal for the tumbler lock to be arranged so that the key can be inserted and withdrawn only when the barrel is located in a particular rotation position.

A difficulty with that type of construction is that the key may be turned back to its initial position and withdrawn before the deadbolt has reached its fully extended deadlock position. As a result, the deadbolt is left in a partially extended position and there is a consequent loss of security because the deadbolt can be forced back into its housing by external influence. Such incomplete extension of the deadbolt may result from an obstruction within the strike and that is a common technique employed to prevent deadlocking and thereby enable subsequent illegal entry.

One proposal for overcoming the foregoing problem is described in U.S. Pat. No. 4,248,068. That construction however, is relatively complicated and expensive because the lost motion necessary for key operation is included within the tubular deadlock assembly.

A further disadvantage of previous deadbolt mechanisms is that the arrangement for driving the deadbolt between its extended and retracted positions includes a large number of parts and is therefore relatively expensive and complicated to assemble.

It is an object of the present invention to provide a relatively simple, yet effective actuator means for locking mechanisms. It is a further object to provide such means which is usable with a conventional deadbolt assembly.

In accordance with the present invention there is provided an actuator assembly for use with a bolt assembly of the kind having a rotatable lever and a bolt which is responsive to rotation of said lever to move between an operative position and an inoperative position; said actuator assembly including a body member securable to a support, an actuator rotatably mounted on said body member, a driving member connected to said actuator for rotation therewith, and a driven member connected to said body member and being rotatable relative thereof, said driving member engaging with and causing rotation of said driven member during part only of rotation thereof in either direction through 360° from a rest position relative to said body member; and a drive spindle being connectable between said driven member and said bolt assembly lever to transmit rotation from one to the other.

Preferably the driving and driven members are both gear segments and the drive spindle is secured to the drive gear segment for rotation therewith and consequently forms an integral part of the actuator assembly. In most cases the actuator will be the barrel of a key operated tumbler lock and that barrel will normally be held in the aforementioned rest position by the lock tumblers. In other cases, any suitable retaining means may be provided to releasably hold the actuator in the rest position.

Although the actuator assembly is usable with most conventional deadbolt assemblies of the tubular kind, it is preferred to provide a relatively simple bolt assembly having a minimum number of components. One suitable form of bolt assembly will be hereinafter described.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

In the drawings:

FIG. 5 is a view similar to FIG. 3, but showing the actuator rotated part way from its rest position as shown in FIG. 3.

FIG. 6 is a view similar to FIG. 5 but showing the assembly at the end of the full 360° movement of the actuator from its rest position.

FIG. 12 is a plan view of the deadbolt and spring of the assembly shown in FIGS. 7 to 10.

FIG. 13 is a cross-sectional view taken along line XIII—XIII of FIG. 12.

Figure 1:
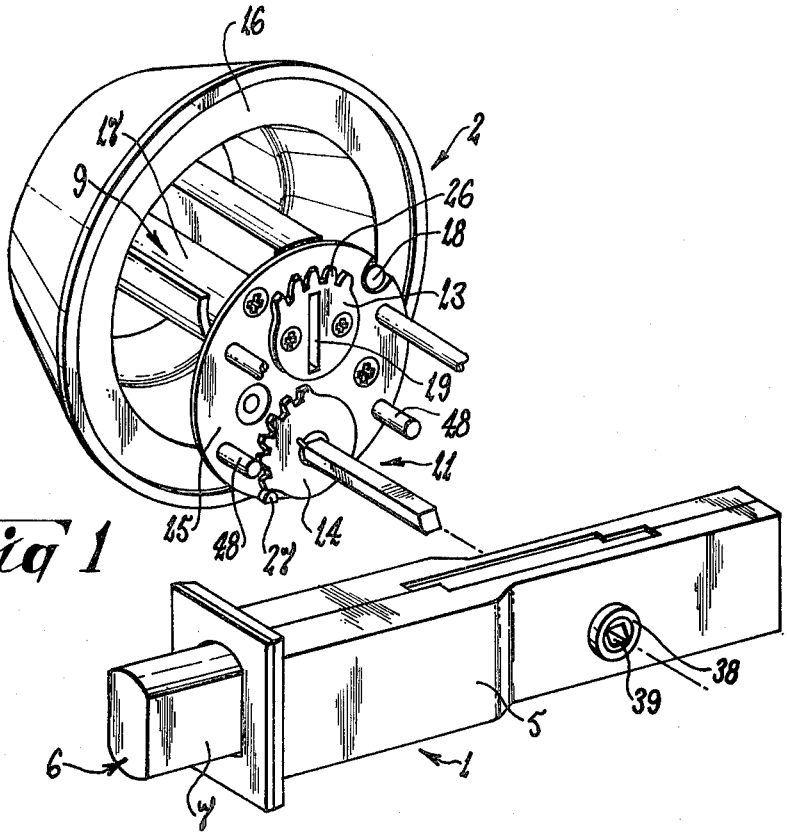
FIG. 1 is a perspective view of one form of actuator assembly according to the invention and a bolt assembly usable with that actuator assembly.
Figures 2, 3, 4, 11:
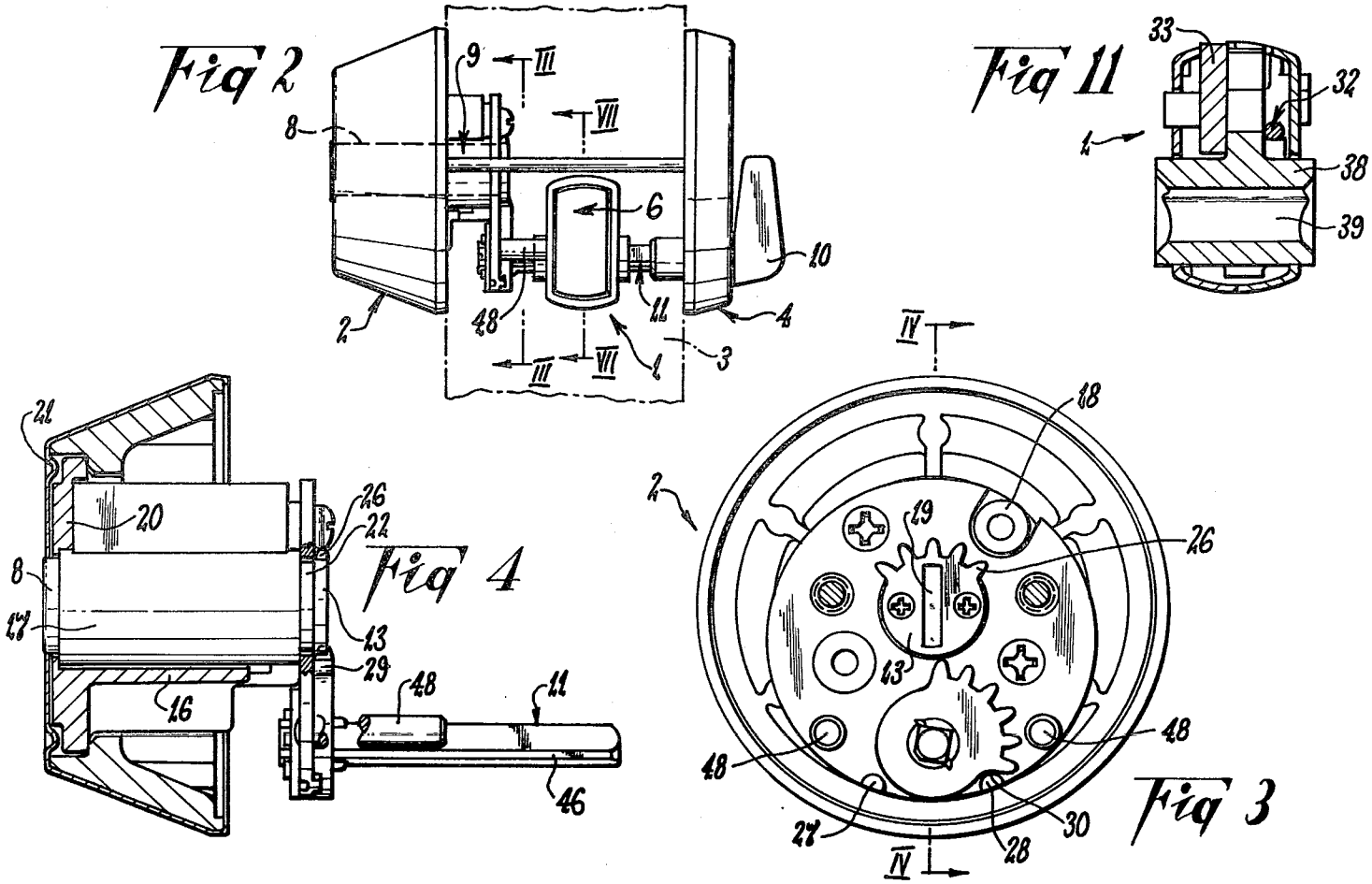
FIG. 2 is an elevation view of the two assemblies of FIG. 1 shown secured to a door together with a hand-operated knob assembly.
FIG. 3 is an end view of the actuator assembly taken along line III—III of FIG. 2.
FIG. 4 is a cross-sectional view taken along line IV—IV of FIG. 3, with some parts not being sectioned for convenience of illustration.
FIG. 11 is a cross-sectional view taken along line XI—XI of FIG. 9.

A typical deadlocking mechanism to which the present invention can be applied includes a bolt assembly 1 and at least one actuator assembly 2 (FIG. 1). FIG. 2 shows the assemblies 1 and 2 of FIG. 1 in association as they would be when mounted on a door 3 and a hand lever assembly 4 is shown on the inside of the door 3. Alternatively, an actuator assembly 2 may be provided for each side of the door 3. The bolt assembly 1 shown includes a housing 5 and deadbolt 6 slidably mounted within the housing 5 for movement between operative and inoperative positions. In the operative position as shown in FIG. 1, a head portion 7 of the deadbolt 6 projects out of one end of the housing 5 and in the inoperative position the head portion 7 is fully or substantially contained within the housing 5.

The actuator assembly 2 includes a lock actuator 8 which is movable into and out of a lock or rest position and which is operative to move the deadbolt 6 between its operative and inoperative positions when the assemblies 1 and 2 are interconnected. In the preferred form shown, the lock actuator 8 is the barrel of a key operated cylinder lock 9 and as stated above such an actuator can be connected to each side of the bolt assembly 1. In the FIG. 2 arrangement however, the actuator at one side (i.e, the inside of the door) is in the form of a turn knob or handle 10 which is connected to the deadbolt 6 through a drive spindle 11 in a known manner so there is no actuator assembly as such.

The lock barrel 8 is preferably arranged so that the key (not shown) can be withdrawn at one rotational position only of the barrel 8, which position will be hereinafter referred to as the rest position. It is further preferred that the barrel 8 must be turned through a complete 360° rotation from the rest position in order to effectively move the deadbolt 6 from one of its extreme positions to the other. The deadbolt 6 is released from the influence of the lock barrel 8 during part of the 360° rotation, but the arrangement is such that the rotation must be completed if the key is to be withdrawn and the deadbolt 6 is to remain at the position intended to be achieved by that rotation. For example, if the deadbolt 6 is being moved towards the operative position (FIGS. 1 and 7), it will be automatically retracted if the barrel 8 is rotated back towards the rest position any time after outward projection of the deadbolt 8 has commenced (see FIGS. 5 and 8). In fact the outward projection may have been completed before the barrel 8 is turned in the reverse direction.

Figure 14:
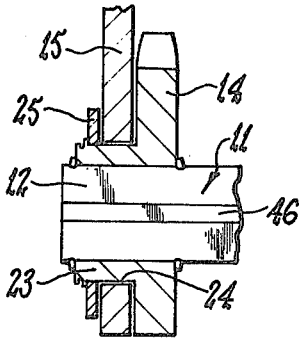
FIG. 14 is a cross-sectional view taken along line XIV—XIV of FIG. 6, but in which the drive shaft is not sectioned for convenience of illustration.

The drive spindle 11, or a separate similar spindle, forms part of the drive connection between the lock barrel 8 and the deadbolt 6. The drive spindle 11 extends parallel to the axis of the lock barrel 8 but as shown is not in alignment with that axis. Also as shown, the drive spindle 11 extends transverse to the direction of movement of the deadbolt 6. The drive spindle 11 is of noncircular cross-section to enable non-rotatable coupling to the deadbolt 6 in a known manner. One end 12 of the spindle 11 however, is preferably rotatably mounted on a mounting plate 15 located at the inner end of the lock barrel 8 (FIG. 14).

The actuator assembly 2 includes drive means which acts between the lock barrel 8 and the drive spindle 11 so that, in use, the deadbolt 6 is positively driven between the operative and inoperative positions in response to rotation of the barrel 8. The drive means includes a driving member 13 connected to the lock barrel 8 for rotation therewith and a co-operative driven member 14 connected to the drive spindle 11. The two members 13 and 14 are relatively arranged so that drive is transmitted from the lock barrel 8 to the drive spindle 11 during part only of the 360° movement of the barrel 8. In the particular example shown, the driving and driven members 13 and 14 co-operatively engage only during that part of the barrel movement corresponding to movement of the deadbolt 6 between its operative and inoperative positions. The members 13 and 14 automatically disengage to break the drive connection between the barrel 8 and the deadbolt 6 when the deadbolt movement has been completed.

It is also preferred that the driving and driven members 13 and 14 engage during an intermediate part of the movement of the lock barrel 8 from the rest position (FIG. 3) in either direction, and the extent of that part would be determined to suit requirements. That is, there will be an initial and final part of the barrel movement during which the barrel 8 has no influence on the deadbolt position. Assuming the lock barrel 8 is moved through the initial part of its movement, the two members 13 and 14 will engage at commencement of the intermediate part of that movement and they will disengage at the end of that intermediate part. At that time the deadbolt 6 will be at its fully extended or fully retracted position according to the direction of rotation of the lock barrel 8. Continued movement of the barrel 8 in the same direction has no affect on the deadbolt 6 because the members 13 and 14 are disengaged and that disengagement continues up to, and beyond the rest position of the lock barrel 8.

It is a significant feature of the construction that the deadbolt 6 is positively driven during that time when the two members 13 and 14 engage. Thus, if the rotation of the lock barrel 8 is reversed from or before reaching the rest position, the two members 13 and 14 will engage at what was previously the disengage position so that continued rotation of the barrel 8 in that reverse direction causes a change in position of the deadbolt 6.

As previously stated, in one possible arrangement, a cylinder lock 9 influences the deadbolt 6 from one side of the mechanism and a turn knob or handle 10 is usable to control the deadbolt position from the other side of the mechanism. Since there is no drive connection between the lock barrel 8 and drive spindle 11 in the rest position of the barrel 8, the turn knob or handle 10 can be operated to move the deadbolt 6 as required. That turn knob or handle 10 can be connected to the drive spindle 11 in a conventional manner and that connection will usually be at the end of the drive spindle 11 opposite to that connected to the lock barrel 8.

The driving member 13 is preferably mounted direct on the lock barrel 8 for rotation with that barrel as shown. In the form shown, the driving member 13 is a gear segment secured to the inner end of the lock barrel 8 and located on an inner side of the mounting plate 15. By way of example, the toothed portion 26 of the driving gear segment 13 may subtend an arc of about 90° and that portion 26 may be located remote from the drive spindle 11 when the lock barrel 8 is in its lock position (FIG. 3).

In the foregoing construction, the driven member 14 is a gear segment also, although a complete gear wheel may be used if desired. In either case, the driven gear member 14 is preferably secured direct to the drive spindle 11 for rotation with that spindle 11.

In the preferred form of the construction as shown, the mounting plate 15 is secured to the end of a body member 16 which houses the lock cylinder 17 and is securable to the door 3 or other support. In particular, the body member 16 is secured to the door 3 separate from the deadbolt housing 5. Locating means 18 may be provided to ensure that the mounting plate 15 cannot be secured to the body member 16 except when disposed at a particular relationship to that body member 16. The keyway 19 of the lock barrel 8 is accessible from the outside end 20 of the body member 16 for key actuation of the lock 9. If desired, a suitable rose or escutcheon 21 may be rotatably mounted on the body member 16, or at least on the end portion thereof remote from the mounting plate 15. The mounting plate 15 and/or the associated body member 16 is adapted to be secured to the door 3 or other support so as to be held against relative movement.

The end portion 22 of the lock barrel 8 adjacent the mounting plate 15 projects through that plate 15 for attachment of the driving gear segment 13. Any means may be employed for that attachment, but the arrangement should be such that the lock barrel 8 and driving gear segment 13 are rotatable as a unit relative to the mounting plate 15. The driven gear segment 14 is also rotatably mounted on the mounting plate 15 and in the form shown in FIG. 14 a boss 23 projecting axially from one side of the gear segment 14 is rotatably located within a hole 24 provided in the mounting plate 15. A stop plate 25 is secured to the end of the boss 23 so as to be located on that side of the mounting plate 15 remote from the driven gear segment 14. As a result, the driven gear segment 14 is secured in rotatable assembly with the mounting plate 15. The stop plate 25 and driven gear segment 14 may be interconnected against relative rotation in any appropriate manner such as by peening or crimping sections of the boss 23 against the stop plate 25.

If desired, stop means may be provided to prevent significant rotation of the driven gear segment 14 beyond the two positions corresponding to the operative and inoperative positions of the deadbolt 6. For example, as shown, the stop means may include two parts 27 and 28 of the mounting plate 15 which project beyond the surface of that plate 15 adjacent to the driven gear. One projection 27 is engageable by a surface 29 of the driven gear segment 14 at one extreme position of the travel of that gear segment 14 (FIG. 3) and the other projection 28 is engageable by another surface 30 of the gear segment 14 at the other extreme of that travel (FIG. 6).

If desired, the locking mechanism may be key operable from both sides of an associated door, in which case a drive connection as described above may be provided at each end of the drive spindle 11.

The construction described above is smoother in operation than the mechanism described in U.S. Pat. No. 4,248,068. In that earlier construction, the necessary lost motion connection is provided within the bolt assembly—i.e., the tubular housing of that assembly—thereby creating a complicated and expensive arrangement. In the present construction, the lost motion is provided for within the actuator assembly and that assembly is usable within conventional or standard types of tubular deadbolts. Thus, the invention enables the commonly known insecure tubular deadlock mechanism to be converted into one having a positive deadlocking action. In addition, the new construction is less expensive to produce and has an improved action as compared with the prior construction.

The actuator assembly 2 as described—i.e., the cylinder lock 9, drive spindle 11 and the associated drive connection—can exist separate from the bolt assembly—i.e., the deadbolt 6 and its associated housing 5—and as previously stated can be used with a conventional tubular deadlock assembly.

FIGS. 7 to 13, shown an improved bolt assembly 1 which may or may not be used in association with the actuator assembly 2 previously described. It is a feature of the improved bolt assembly 1 that an operating lever 31, which acts between the drive spindle 11 and the bolt 6, is both biased and held in operative association with the bolt by a single spring 32. It is a further feature that a single operating lever 31 influences movement of the bolt 6, whereas in prior constructions it was generally necessary to provide such a lever on each of two sides of the bolt. The aforementioned features may exist separately or in combination.

Figure 7:
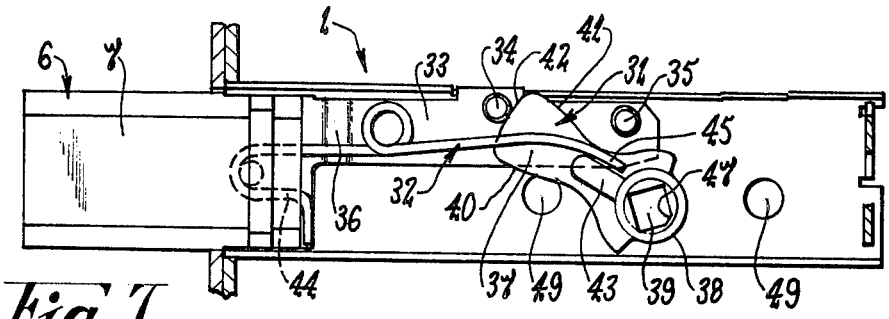
FIG. 7 is a cross-sectional view taken along line VII—VII of FIG. 2, and showing the deadbolt in its operative position.
Figure 9:
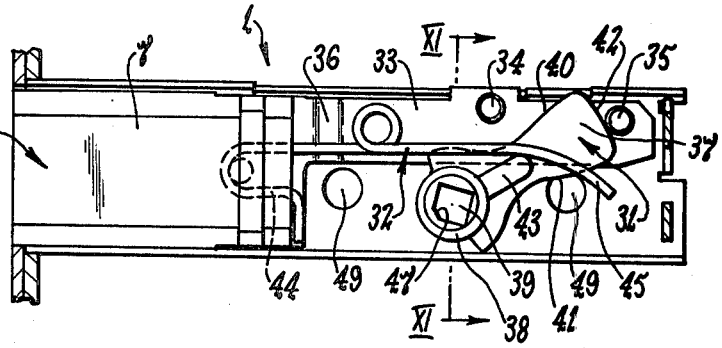
FIG. 9 is a view similar to FIG. 8, but showing the deadbolt fully retracted and therefore in a position corresponding to the actuator position of FIG. 6.

In the preferred form of the deadbolt assembly 1 as shown, the deadbolt 6 has a rearward extension 33 which remains within the housing 5 at all times. The operating lever 31 is also located within the housing 5 and acts between the drive spindle 11 and the deadbolt 6 for driving the deadbolt 6 between the operative and inoperative positions as shown in FIGS. 7 and 9 respectively. For that purpose, the operating lever 31 locates between and is engageable with a pair of abutments 34 and 35 provided on the rearward extension 33 of the deadbolt 6.

The rearward extension 33 may be integral with the deadbolt head portion 7 or it may be a separately formed member rigidly secured to the rear end of the head portion 7. In either case, it is preferably an elongate platelike member which is stepped laterally at a location 36 partway along its length (FIG. 12).

The operating lever 31 may also be of plate-like form and is located at one side of and close to the deadbolt rearward extension 33. In the form shown, the operating lever 31 includes a body portion 37 which lies alongside the rearward extension and a bearing portion 38 which is rotatably mounted on the housing 5. The bearing portion 38 has a non-circular bore 39 therethrough which receives the drive spindle 11 in such a manner that the operating lever 31 rotates in response to rotation of the drive spindle 11.

Figure 8:
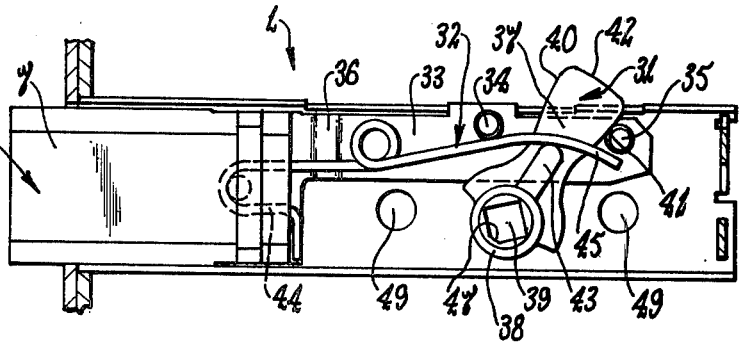
FIG. 8 is a view similar to FIG. 7 but showing the deadbolt partially retracted and therefore in a position substantially corresponding to the actuator position shown in FIG. 5.

The abutments 34 and 35 of the deadbolt rearward extension 33 are preferably in the form of two pins projecting laterally from one side of the rearward extension 33 and which are spaced apart in the longitudinal direction of the rearward extension 33 (FIG. 12). As previously stated, the body portion 37 of the operating lever 31 is located between the abutment pins 34 and 35 and forward and rearward edges 40 and 41 of that body portion 37 are each engageable with a respective pin 34 and 35. The lever 31 may be arranged so that during the final stage of its movement in either direction, engagement with the pin 34 or 35 is transferred from the forward or rearward edge 40; 41 to an upper edge 42 of the lever 31 (FIGS. 7 and 9). For that purpose, a curved transition zone is provided between each of the forward and rearward edges 40 and 41 and the upper edge 42 of the operating lever 31. The arrangement is such that during retraction of the deadbolt 6 for example, the drive to the deadbolt 6 is transmitted firstly by the rearward edge 41 of the operating lever 31 and, as the operating lever 31 pivots with movement of the drive spindle 11, is subsequently transmitted by the upper edge 42 of the operating lever 31 (FIGS. 8 and 9). Such an arrangement enables a relatively small lever 31 to be used for transmitting the motion of the drive spindle 11 to the deadbolt 6 and consequently the assembly 1 can be relatively compact.

Some lost motion may be provided between the lever 31 and the deadbolt 6 during operation of the mechanism, and that may be achieved by spacing the abutment pins 34 and 35 on the rearward extension 33 such when the operating lever 31 is moved from either of its extreme positions it must move through a predetermined distance before engaging the appropriate pin 34 or 35 (see FIGS. 7 and 8). This lost motion is additional to that provided by the gear segments 13 and 14 of the spindle drive connection previously described.

The bolt assembly includes a biasing spring 32 which preferably functions to resist the first stages of bolt movement from one extreme position to the other and to assist the remaining stages of bolt movement. In the arrangement shown, the biasing spring 32 acts upon the operating lever 31 to provide the aforementioned resistance and assistance, and for that purpose the spring 32 may be arranged to be deformed during the first stages of bolt movement (FIG. 8) and to relax during the latter stages of bolt movement (FIG. 9). The operating lever 31 may be provided with a lateral projection 43 which bears against the spring 32 so that, as the lever 31 is moved by rotation of the drive spindle 11, the projection 43 presses against and deforms the spring 32. That deformation increases progressively until the operating lever 31 reaches approximately the mid-part of its range of movement and thereafter the spring 32 moves back towards its original condition and in so doing assists the latter part of the lever movement.

Figure 10:
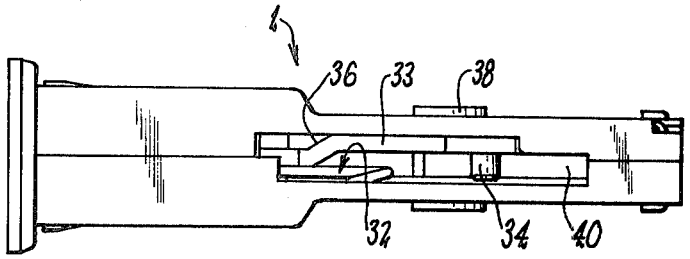
FIG. 10 is a plan view of the bolt assembly of FIGS. 7 to 9.

The biasing spring 32 is also preferably arranged to bear against one side of the operating lever 31 to retain that lever 31 in face to face engagement with the deadbolt rearward extension 33 (FIG. 10). That is, by applying a lateral pressure to the lever 31 the spring 32 ensures that the body portion 37 of the lever 31 remains between the abutment pins 34 and 35.

The biasing spring 32 may comprise an elongate wire or rod member which has a forward end 44 secured to the deadbolt 6 and which extends rearwardly along one side of the deadbolt rearward extension 33. A rearward portion 45 of the spring 32 is preferably turned inwards towards the deadbolt rearward extension 33 so as to press the operating lever 31 against that extension 33. The projection 43 of the operating lever 31 lies between the spring 32 and the drive spindle 11 and is operative to deform the spring 32 away from the spindle 11 when the spindle 11 is rotated from either of its extreme positions.

The above described bolt assembly 1 enables the deadbolt 6 to be operated by a single operating lever 31 and spring 32, which constitute the only components operative in transmitting the drive from the spindle 11 to the deadbolt 6. Such a construction is considerably simpler both in assembly and operation than prior constructions.

It will be appreciated that, because of the lost motion in the actuator assembly 2, care must be taken to ensure that the drive spindle 11 and the operating lever 31 have a correct relationship when the actuator and bolt assemblies 2 and 1 are combined. For that purpose, means may be provided to prevent the combination being made unless the correct relationship applies. In the construction shown, that is achieved by arranging the cross sectional shape of the spindle 11 and the complimentary bore 39 of the control lever 31 so that the spindle 11 will be received by the bore 39 only when the two components have a particular relationship. In the example shown, the spindle 11 is substantially square in cross section except for a longitudinally extending flat surface 46 provided along one edge (FIG. 4), and the bore 39 has a substantially complimentary shape in that a flat 47 is provided in one corner (FIGS. 7 to 9).

Guide means may be provided to assist in correct relative location of the actuator and bolt assemblies 2 and 1 when those assemblies are being combined. In the form shown, a pair of guide pins 48 secured to and extending from the mounting plate 15 are slidably received in complimentary holes 49 formed through the bolt housing 5.

Finally, it is to be understood that various alterations, modifications and additions may be made to the construction and arrangements of parts as herein described without departing from the spirit of the invention as defined by the appended claims.

Having now described our invention what we claim as new and desire to secure by Letters Patent is:

1. An actuator assembly for use with a bolt assembly of the kind having a tubular housing securable to a support, a lever rotatably mounted on said housing and a bolt slidably mounted within said housing and being responsive to rotation of said lever to move between an operative position and an inoperative position; said actuator assembly including a body member securable to said support separate from said housing, an actuator rotatably mounted on said body member, means releasably retaining said actuator in a rest position relative to said body member, a driving gear segment secured to said actuator for rotation therewith, mounting means secured to said body member against movement relative thereto, a driven gear member rotatably mounted on said mounting means, stop means on said mounting means limiting rotation of said driven gear member between two extreme positions, and a drive spindle connected to said driven gear member for rotation therewith and being connectable to said bolt assembly lever to cause rotation thereof, said driving gear segment engaging with and causing rotation of said driven gear member during part only of its rotation in either direction through 360° from said rest position.

2. An actuator assembly according to claim 1, wherein said actuator is a rotatable barrel of a key operated tumbler lock, the keyway of said lock being accessible at one end of said body member, said mounting means comprises a plate secured to the end of said body member opposite said one end thereof, said barrel projects through and is rotatable relative to said plate, said driving gear segment is secured to said barrel to be located at the side of said plate remote from said body member, and said driven gear member is mounted on said plate at a location such that its rotational axis is laterally spaced from but is substantially parallel to the rotational axis of said barrel.

3. An actuator assembly according to claim 1, when co-operatively assembled with a said bolt assembly, said lever having a bore therein which receives said drive spindle, said drive spindle and lever bore having substantially complementary non-circular cross-sectional shape, and said drive spindle extends transverse to the line of movement of said deadbolt.

4. An actuator assembly according to claim 3, wherein said cross-sectional shape is such that said drive spindle is receivable within said lever bore at one rotational position only of said drive spindle relative to said lever.

5. An actuator assembly according to claim 3, wherein guide means on said actuator assembly co-operatively engages with said housing to retain said two assemblies in correct relationship.

* * * * *